US005079984A

United States Patent [19]

Kosugi et al.

[11] Patent Number: 5,079,984

[45] Date of Patent: Jan. 14, 1992

[54] MIDI SIGNAL PROCESSOR

[75] Inventors: Tsuneo Kosugi, Tokyo; Kazuo Hikawa, Yokohama, both of Japan

[73] Assignee: Victor Company of Japan, Ltd., Japan

[21] Appl. No.: 487,076

[22] Filed: Mar. 1, 1990

[30] Foreign Application Priority Data

Mar. 2, 1989 [JP] Japan ..... 1-50652
Mar. 2, 1989 [JP] Japan ..... 1-50653

[51] Int. Cl.[5] ..... G10H 1/42; G10H 1/46
[52] U.S. Cl. ..... 84/645; 84/609
[58] Field of Search ..... 84/645, 602, 621, 615, 84/616, 609, 618

[56] References Cited

U.S. PATENT DOCUMENTS 4,662,261 5/1987 Akutsu ..... 84/645
4,924,745 5/1990 Kimpara et al. ..... 84/609
4,942,551 7/1990 Klappert et al. ..... 84/645
5,009,147 5/1991 Yamamori ..... 84/618

FOREIGN PATENT DOCUMENTS 62-146470 6/1987 Japan .

*Primary Examiner*—William M. Shoop, Jr.
*Assistant Examiner*—Helen Kim
*Attorney, Agent, or Firm*—Lowe, Price, LeBlanc & Becker

[57] ABSTRACT

In a MIDI signal processor, note on messages and note off messages are extracted from an input MIDI signal. A device detects that a first extracted note on message of a channel number and a note number is followed by a second extracted note on message of the same channel number and same note number without being followed by an extracted note off message of the same channel number and the same note number. The first note on message is outputted but output of the second note on message is inhibited when the detecting device detects that the first note on message is followed by the second note on message without being followed by the note off message.

7 Claims, 12 Drawing Sheets

| | R S T U V W | | | | | |
|---|---|---|---|---|---|---|
| FRAME 0 | MODE | | ITEM | | | |
| 1 | 0 | 0 | $n_3$ | $n_2$ | $n_1$ | $n_0$ |
| 2 | Q0 | | | | | |
| 3 | Q1 | | | | | |
| 4 | a0 | | | | | |
| 5 | a0' | b0 | | | | |
| 6 | b0' | c0 | | | | |
| 7 | c0' | | | | | |
| 8 | a1 | | | | | |
| 9 | a1' | b1 | | | | |
| 10 | b1' | c1 | | | | |
| 11 | c1' | | | | | |
| 12 | a2 | | | | | |
| 13 | a2' | b2 | | | | |
| 14 | b2' | c2 | | | | |
| 15 | c2' | | | | | |
| 16 | a3 | | | | | |
| 17 | a3' | b3 | | | | |
| 18 | b3' | c3 | | | | |
| 19 | c3' | | | | | |
| 20 | P0 | | | | | |
| 21 | P1 | | | | | |
| 22 | P2 | | | | | |
| 23 | P3 | | | | | |
| FA | | | | | | |

$n_3$-$n_0$ : NUMBER OF MIDI BYTES IN PACK

1 PACK

MIDI DATA

| | START BIT 0 | 1 | 2 | 3 | 4 | 5 | 6 | 7 | 8 | STOP BIT 9 |
|---|---|---|---|---|---|---|---|---|---|---|
| MIDI BYTE 0: | 0 | a0 | | | | | | a0' | | 1 |
| MIDI BYTE 1: | 0 | b0 | | | | b0' | | | | 1 |
| MIDI BYTE 2: | 0 | c0 | | c0' | | | | | | 1 |
| MIDI BYTE 3: | 0 | a1 | | | | | | a1' | | 1 |
| MIDI BYTE 4: | 0 | b1 | | | | b1' | | | | 1 |
| MIDI BYTE 5: | 0 | c1 | | c1' | | | | | | 1 |
| MIDI BYTE 6: | 0 | a2 | | | | | | a2' | | 1 |
| MIDI BYTE 7: | 0 | b2 | | | | b2' | | | | 1 |
| MIDI BYTE 8: | 0 | c2 | | c2' | | | | | | 1 |
| MIDI BYTE 9: | 0 | a3 | | | | | | a3' | | 1 |
| MIDI BYTE 10: | 0 | b3 | | | | b3' | | | | 1 |
| MIDI BYTE 11: | 0 | c3 | | c3' | | | | | | 1 |
| MA | | | | | | | | | | |

MIDI SIGNAL PROCESSOR

BACKGROUND OF THE INVENTION

1. Field of the Invention

This invention relates to an apparatus for processing a digital signal such as a digital signal in MIDI (Musical Instrument Digital Interface) format designed to control electronic musical instruments.

2. Description of the Prior Art

Conventional MIDI format for a digital signal is designed to control electronic musical instruments. In a known MIDI-based music control system, MIDI signals are transmitted between various electronic musical instruments and a keyboard so that the musical instruments can be driven and controlled by operating the single keyboard.

Japanese published unexamined patent application 62-146470 discloses a digital information recording and reproducing system. In the system of Japanese patent application 62-146470, 8-bit MIDI code words representative of control information such as an interval, a scale, and a length of a note (sound) is recorded on a magnetic tape by a tape recorder of the helical scan type. When the MIDI words are reproduced from the magnetic tape, a start bit and a stop bit are added to each of the reproduced MIDI words to compose a 10-bit MIDI signal designed to drive and control electronic musical instruments.

A compact disk (CD) is an excellent recording medium for storing a large amount of digitized information. Since CD signal format and MIDI signal format are significantly different from each other, it is generally difficult to directly record MIDI words on a compact disk. For example, a MIDI word has 8 bits while a usable part of a CD subcode has 6 bits. In addition, the bit rate of the MIDI system is 31,250 bps (bit per second) while the bit rate of the CD subcode is 28,800.

A conventional MIDI system lacks the ability to cope with the occurrence of an uncorrectable MIDI data error or a sudden interruption of the transmission of a MIDI signal. Therefore, in such a case, some of electronic musical instruments of the MIDI system tend to continue the generation of notes (sounds), and the note generation control is disabled.

SUMMARY OF THE INVENTION

It is an object of this invention to provide an excellent MIDI signal processor.

According to a first aspect of this invention, a MIDI signal processor comprises means for extracting note on messages and note off messages from an input MIDI signal; means for detecting that a first extracted note on message of a channel number and a note number is followed by a second extracted note on message of said channel number and said note number without being followed by an extracted note off message of said channel number and said note number; and means for outputting the first note on message but inhibiting output of the second note on message when said detecting means detects that the first note on message is followed by the second note on message without being followed by the note off message.

According to a second aspect of this invention, a MIDI signal processor comprises means for reading out a signal from a digital signal recording medium having a sub signal recording area storing MIDI data; decoding means for subjecting the readout signal to an EFM decoding process; means for generating a control signal when an uncorrectable error occurs, when a non-reproducing condition occurs, and when a part of the signal disappears; a memory having a predetermined area where at least one bit is allotted to each of different MIDI messages; means for initializing the predetermined area of the memory to initial values; means for, in cases where MIDI data reproduced by the decoding means is a message representing a non-default state, reading a predetermined bit in a predetermined address of the predetermined area of the memory which corresponds to said message, writing a value different from the initial value into the read bit and transmitting the reproduced MIDI message when the read bit equals the initial value, and inhibiting transmission of the reproduced MIDI message when the read bit differs from the initial value; means for, in cases where MIDI data reproduced by the decoding means is a message representing a default state, reading a predetermined bit in a predetermined address of the predetermined area of the memory which corresponds to said message, writting the initial value into the read bit and transmitting the reproduced MIDI message when the read bit differs from the initial value, and inhibiting transmission of the reproduced MIDI message when the read bit equals the initial value; and means for, in cases where the control signal is generated, reading the predetermined area of the memory, transmitting a message representing a default state of a MIDI message corresponding to a bit of an address which differs from the initial value, and writing the initial value into said bit of said address.

According to a third aspect of this invention, a MIDI signal processor comprises means for reading out a signal from a digital signal recording medium having a sub signal recording area storing MIDI data; decoding means for subjecting the readout signal to an EFM decoding process; means for generating a control signal when an uncorrectable error occurs, when a non-reproducing condition occurs, and when a part of the signal disappears; a memory having a predetermined area where at least one byte is allotted to one note number; means for initializing the predetermined area of the memory to initial values different from any note numbers; means for, in cases where MIDI data reproduced by the decoding means is a note on message, sequentially writing a value corresponding to a note number of the note on message into addresses of a pre-initialized storage area of the memory; and control means for, in cases where MIDI data reproduced by the decoding means is a note off message, initializing a value corresponding to a note number of the note off message when the value was written into the storage area, and inhibiting transmission of a note on message to MIDI output in an absence of an initialized address, the control means being operative to, in cases where the control signal is generated, search the storage area and generate and transmit a note off message of a note number corresponding to a value in a non-initialized address to the MIDI output.

DESCRIPTION OF THE FIRST PREFERRED EMBODIMENT

A first embodiment of this invention is based on the following principle. It is now assumed that an uncorrectable MIDI data error occurs or an operating instruction such as "stop" and "search" is given so that a part of MIDI data disappears during a MIDI data reproduction process. If the disappearing MIDI data contains a note off message of a certain note number, two note on messages of the same note number can be reproduced successively without the note off message therebetween. Some MIDI musical instruments do not suspend the generation of notes (tones) in response to a single note off message after they receive two note on messages successively without the note off message therebetween. Accordingly, the inhibition of the successive transmission of two note on messages can prevent the continuous generation of a note (sound) in the case of an disappearance of reproduced MIDI data.

Figure 1:
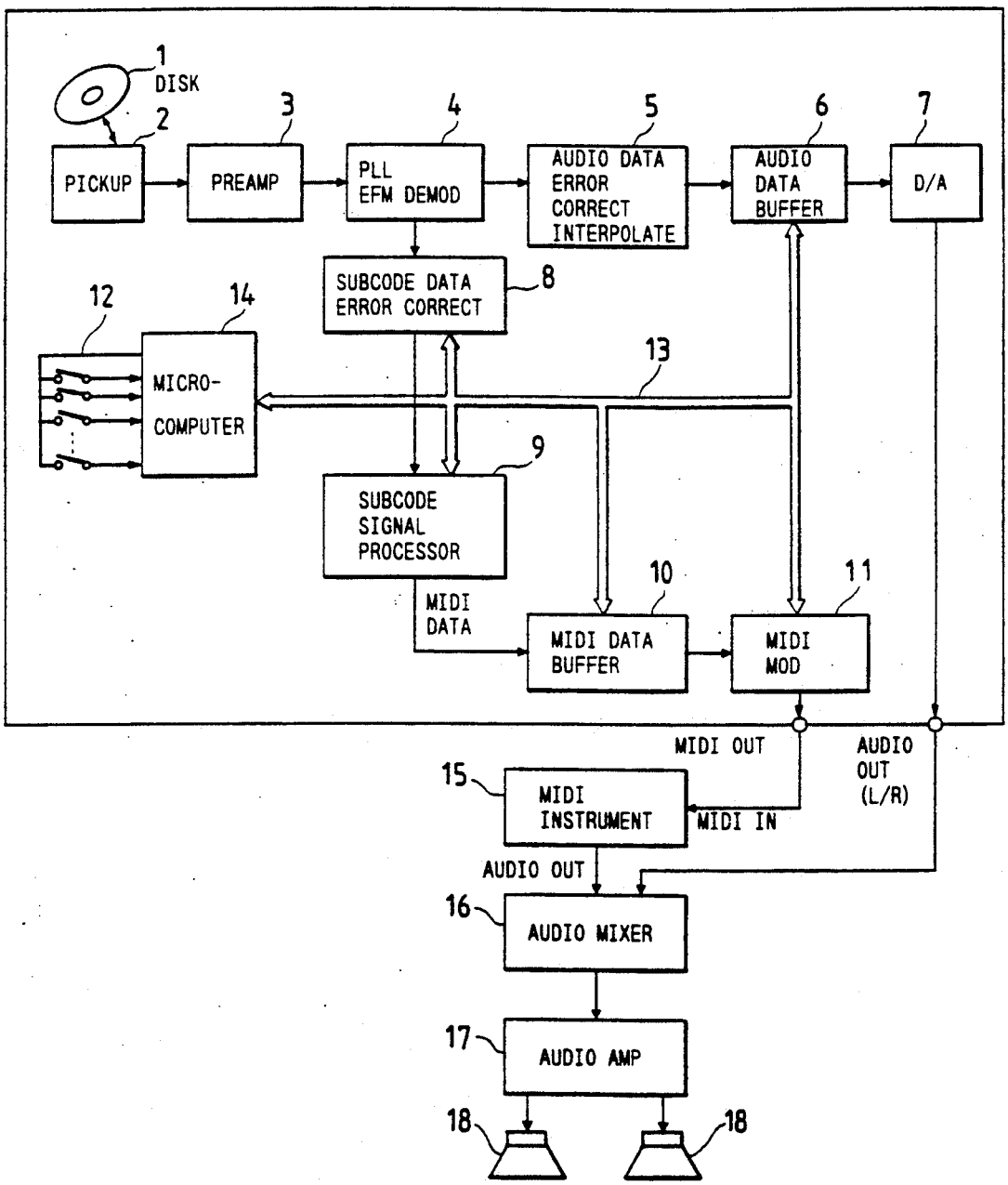
FIG. 1 is a block diagram of a MIDI signal processor according to a first embodiment of this invention.

The first embodiment of this invention will now be described in detail. With reference to FIG. 1, CD data are read out from a CD 1 by an optical pickup 2. The readout data are fed from the optical pickup 2 to a PLL EFM demodulator 4 via a photodetector preamplifier 3. The PLL EFM demodulator 4 processes the input data through EFM demodulation and derives audio data and subcode data from the input data.

The audio data are outputted from the PLL EFM demodulator 4 to an audio data error correction and interpolation circuit 5. The audio data error correction and interpolation circuit 5 performs error correction and interpolation of the input audio data. Output audio data from the audio data error correction and interpolation circuit 5 are fed via an audio data buffere 6 to a digital-to-analog (D/A) converter 7, and are converted by the D/A converter 7 into a corresponding analog audio signal. The analog audio signal is outputted from the D/A converter 7.

The subcode data are fed from the PLL EFM demodulator 4 to an error detection and correction circuit 8 which performs error detection and correction of the fed subcode data. A subcode signal processor 9 demodulates MIDI data from the output subcode data of the error detection and correction circuit 8. The MIDI data are fed from the subcode signal processor 9 to a MIDI modulator 11 via a MIDI data buffer 10, and are modulated by the MIDI modulator 11 into a modulated MIDI signal. The modulated MIDI signal is outputted from the MIDI signal modulator 11.

A microcomputer 14 is connected via a bus 13 to the devices 6, 8, 9, 10, and 11. An operation switch unit 12 including a plurality of switches outputs various operation instructing signals such as "stop", "search", "fast forward", and "play" to the microcomputer 14. The microcomputer 14 performs control operation to prevent annoying phenomena and malfunctions which could be caused in cases where an uncorrectable MIDI data error occurs or an operating instruction such as "stop" and "search" is given so that a part of MIDI data disappears. The annoying phenomena and malfunctions are the continuous generation of notes (sounds), the continuation of rhythm, the wrong sync of rhythm, and a malfunction of the note generation control.

The output MIDI signal from the MIDI modulator 11 is fed to a MIDI musical instrument 15. The MIDI signal is converted by the MIDI musical instrument 15 into a corresponding audio signal. The audio signal is fed from the MIDI musical instrument 15 to an audio mixer 16. The audio output signal from the D/A converter 7 is also fed to the audio mixer 16. The audio mixer 16 combines the audio output signals from the devices 7 and 15. An audio output signal from the audio mixer 16 is fed via an audio amplifier 17 to loudspeakers 18, and is converted by the loudspeakers 18 into corresponding notes or sounds.

Figures 2, 3, 4:
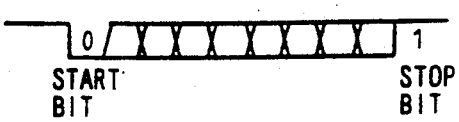
FIG. 2 is a diagram showing the format of a subcode data pack for a compact disk.
FIG. 3 is a diagram of the waveform of a one-byte MIDI signal which is being transmitted.
FIG. 4 is a diagram of the arrangement of MIDI data where the MIDI data are separated into a set of one-byte blocks each additionally provided with a start bit and a stop bit.

The format of recording of subcode data into a compact disk (CD) will be explained hereinafter. FIG. 2 shows stored conditions of subcode data, the amount of which corresponds to one pack of the CD subcode channel, that is, a set of the 0-th frame to the 23-rd frame. Each frame has 6 usable bits R, S, T, U, V, and W representing data. MIDI data are stored into the 4-th frame to 19-th frame. A unit of MIDI data is a byte, that is, 8 bits. The first MIDI data byte is divided into two parts a0 and a0′ contained in the bits R-W of the 4-th frame and the bits R and S of the 5-th frame respectively. The second MIDI data byte is divided into two parts b0 and b0′ contained in the bits T-W of the 5-th frame and the bits R-U of the 6-th frame respectively. In such a manner. successive 12 MIDI data bytes are each divided into two parts and are sequentially stored into the 4-th frame to 19-th frame.

FIG. 3 shows a waveform of one unit of a MIDI signal during transmission. One unit of the MIDI signal has a start bit "0", 8-bit MIDI data following the start bit, and a stop bit "1" following the MIDI data.

FIG. 4 shows the structure of one pack of a MIDI signal during transmission. The divided two parts a0 and a0′ of the first MIDI data byte are combined again to restore the complete form of the first MIDI data byte. The start bit "0" and the stop bit "1" are added to the head and the end of the first MIDI data byte respectively. The divided two parts b0 and b0′ of the second MIDI data byte are combined again to restore the complete form of the second MIDI data byte. The start bit "0" and the stop bit "1" are added to the head and the end of the second MIDI data byte respectively. In such a manner, 12 MIDI data bytes are restored in form and the start bit "0" and the stop bit "1" are added to each MIDI data byte.

According to the MIDI standards, MIDI data are transmitted at a bit rate of 3,125 bytes per second. A general CD player (reproducing apparatus) outputs 300 packs per second in compliance with the CD signal transmission format. Therefore, the CD player has the ability to output 3,600 bytes of MIDI data per second. In order to meet the requirement for the bit rate of 3,125 bytes per second, only 3,125 bytes of MIDI data are previously stored into 300 packs of the CD subcode channel.

For example, 300 packs are separated into 25 groups each having 12 packs. In each group, 5 packs have 11 bytes of MIDI data each and 7 packs have 10 bytes of MIDI data each. Therefore, each group has 125 bytes of MIDI data, and 300 packs have 3,125 bytes of MIDI data.

In another example, 300 packs are separated into 25 groups each having 12 packs. In each group, some packs have 12 bytes of MIDI data each and the remaining packs have 11 or less bytes of MIDI data each while the sum of the numbers of bytes of the MIDI data are limited to 125. Therefore, each group has 125 bytes of MIDI data, and 300 packs have 3,125 bytes of MIDI data. This example is made in consideration of the following fact. Most of MIDI data are 3-byte note on messages or 3-byte note off messages. Handling MIDI data in a block of 12 bytes is advantageous since 12 bytes are a multiple of 3 bytes related to such messages. In this way, the number of MIDI bytes being transmitted for each pack can be chosen arbitrarily in a range equal to or less than 12. The number of bytes is indicated in the second frame in each pack (see FIG. 1). In addition, in the case where the MIDI data has 11 bytes or less, the whole of the unused region of the 12-th byte is occupied by "0".

Figure 5:
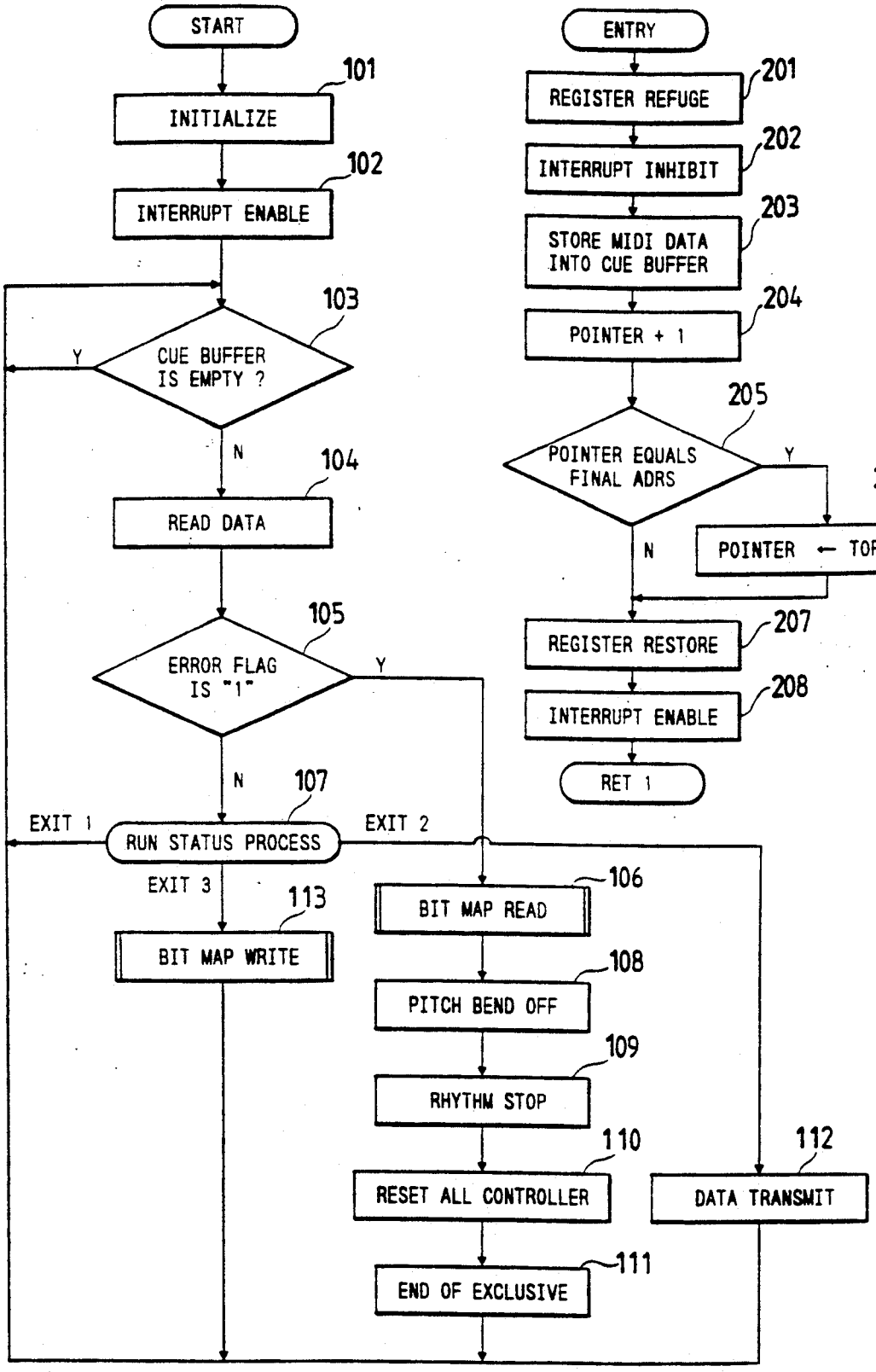
FIG. 5 is a flowchart of a main routine of a program operating the microcomputer of FIG. 1.

The microcomputer 14 includes a combination of a CPU, a ROM, and other memories. The microcomputer 14 operates in accordance with a program stored in the ROM. FIG. 5 is a flowchart of a main routine of the program.

As shown in FIG. 5, a first step 101 of the main routine of the program initializes storage areas of a RAM within the MIDI data buffer 10. After the step 101, the program advances to a step 103 via an interruption enabling step 102. The step 103 checks whether or not a cue buffer prepared in the RAM of the MIDI data buffer 10 is empty. When the cue buffer is empty, the step 103 is reiterated. When the cue buffer is not empty, the program advances to a step 104 which reads out data from the cue buffer.

A step 105 checks whether or not an error generation flag is "1". When the error generation flag is "1", the program advances to a block 106. When the error generation flag is not "1", the program advances to a block 107. In the block 106, stored information on MIDI messages transmitted before is read from a bit map, and the note off messages relative to the information are transmitted. Then a pitch bend off message, a rhythm stop message, a reset all controller message, and an end of exclusive message are transmitted successively to the MIDI modulator 11, in the same manner (see steps 108 to 111). After the step 111, the program returns to the step 103.

The block 107 executes a running status process. As will be made clear later, the block 107 has three exits. When the program goes out via the first exit of the block 107, the program returns to the step 103. When the program goes out via the second exit of the block 107, the program advances to a step 112. When the program goes out via the third exit of the block 107, the program advances to a block 113. The step 112 transmits data from a receiving buffer prepared in the RAM of the MIDI data buffer 10. After the step 112, the program returns to the step 103. In the block 113, information on incoming MIDI messages is written into a bit map as new information and the MIDI messages are transmitted. After the block 113, the program returns to the step 103.

Figure 6:
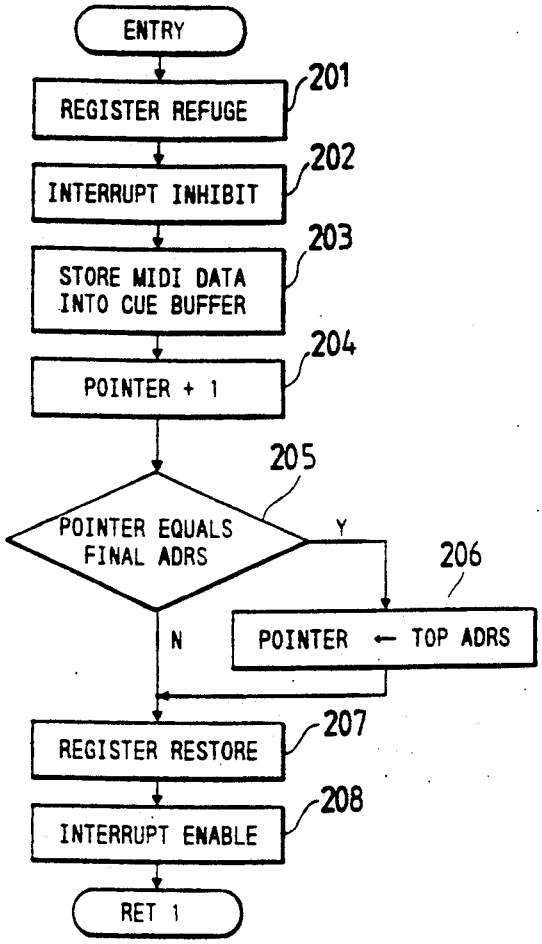
FIG. 6 is a flowchart of a part of the program which is executed by an interruption process.

FIG. 6 is a flowchart of a segment of the program which is executed by an interruption process each time the MIDI data are inputted into the receiving buffer. As shown in FIG. 6, a first step 201 of the segment of the program gives refuge to a register. A step 202 following the step 201 executes an interruption inhibiting process. A step 203 following the step 202 stores MIDI data into the cue buffer. A step 204 following the step 203 increments a pointer by "1". A step 205 following the step 204 checks whether or not the pointer equals a final address. When the pointer equals the final address, the program advances to a step 206. When the pointer does not equal the final address, the program advances to a step 207. The step 206 sets a top address in the pointer. After the step 206, the program advances to the step 207. The step 207 returns the register into an operable state. A step 208 following the step 207 executes an interruption enabling process. After the step 208, the program returns to the main routine.

Figure 7:
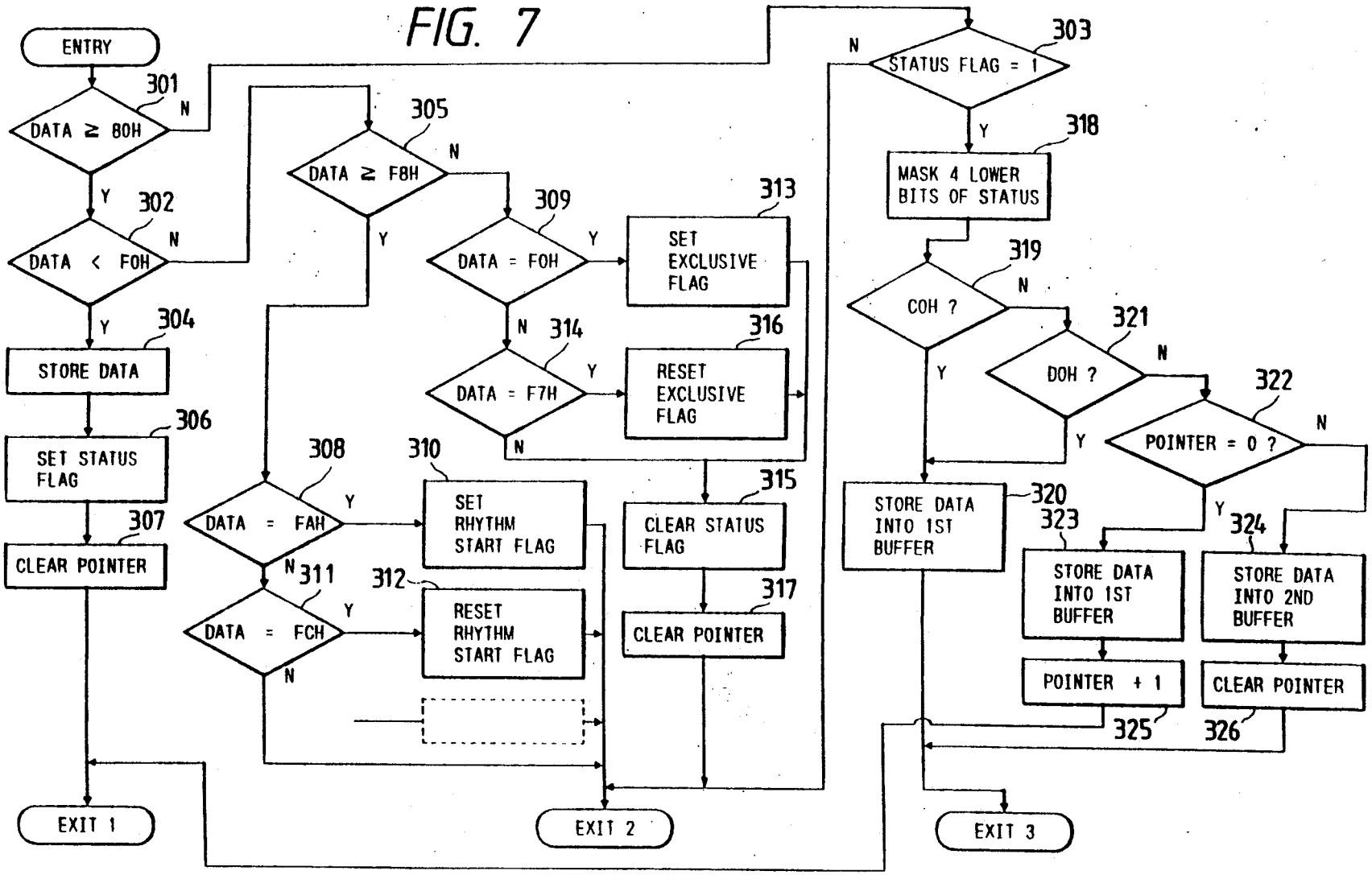
FIG. 7 is a flowchart of an internal program in the running status processing block of FIG. 5.

FIG. 7 is a flowchart of an internal program of the running status processing block 107. As shown in FIG. 7, a first step 301 of the block 107 checks whether or not data are equal to or greater than "80H". Here, "H" means that the preceding "80" is represented in hexadecimal expression. In a later description, some data are similarly represented in hexadecimal expression. When the data are equal to or greater than "80H", the program advances to a step 302. When the data are smaller than "80H", the program advances to a step 303. The step 302 checks whether or not the data are smaller than "F0H". When the data are smaller than "F0H", the program advances to a step 304. When the data are not smaller than "F0H", the program advances to a step 305. The step 304 stores a running status into a status buffer prepared in the RAM of the MIDI data buffer 10. A step 306 following the step 305 sets a status flag. A step 307 following the step 306 clears the data pointer. After the step 307, the program goes out via the first exit.

The step 305 checks whether or not the data are equal to or greater than "F8H". When the data are equal to or greater than "F8H", the program advances to a step 308. When the data are smaller than "F8H", the program advances to a step 309. The step 308 checks whether or not the data are equal to "FAH". When the data are equal to "FAH", the program advances to a step 310. When the data are not equal to "FAH", the program advances to a step 311. The step 310 sets a rhythm start flag. After the step 310, the program goes out via the second exit. The step 311 checks whether or not the data are equal to "FCH". When the data are equal to "FCH", the program advances to a step 312. When the data are not equal to "FCH", the program goes out via the second exit. The step 312 resets the rhythm start flag. After the step 312, the program goes out via the second exit. The step 309 checks whether or not the data are equal to "F0H". When the data are equal to "F0H", the program advances to a step 313. When the data are not equal to "F0H", the program advances to a step 314. The step 313 sets a system exclusive flag. After the step 313, the program advances to a step 315. The step 314 checks whether or not the data are equal to "F7H". When the data are equal to "F7H", the program advances to a step 316. When the data are not equal to "FCH", the program advances to the step 315. The step 316 resets the system exclusive flag. After the step 316, the program advances to the step 315. The step 315 clears the status flag. A step 317 following the step 315 clears the data pointer. After the step 317, the program goes out via the second exit.

The step 303 checks whether or not the status flag is "1". When the status flag is "1", the program advances to a step 318. When the status flag is not "1", the program goes out via the second exit. The step 318 masks 4 lower bits of the stored contents of the status buffer by forcedly setting the 4 lower bits to "0000". A step 319 following the step 318 checks whether or not the data obtained by the step 318 are equal to "C0H". When the data are equal to "C0H", the program advances to a step 320. When the data are not equal to "C0H", the program advances to a step 321. The step 320 stores the data into a first-byte data buffer prepared in the MIDI data buffer 10. After the step 320, the program goes out via the third exit. The step 321 checks whether or not the data obtained by the step 318 are equal to "D0H". When the data are equal to "D0H", the program advances to the step 320. When the data are not equal to "D0H", the program advances to a step 322. The step 322 checks whether or not the data pointer equals "0". When the data pointer equals "0", the program advances to a step 323. When the data pointer does not equal "0", the program advances to a step 324. The step 323 stores the data into the first-byte data buffer in the MIDI data buffer 10. A step 325 following the step 323 increments the data pointer by "1". After the step 325, the program goes out via the first exit. The step 324 stores the data into a second-byte data buffer in the MIDI data buffer 10. A step 326 following the step 324 clears the data pointer. After the step 326, the program goes out via the third exit.

Figure 8:
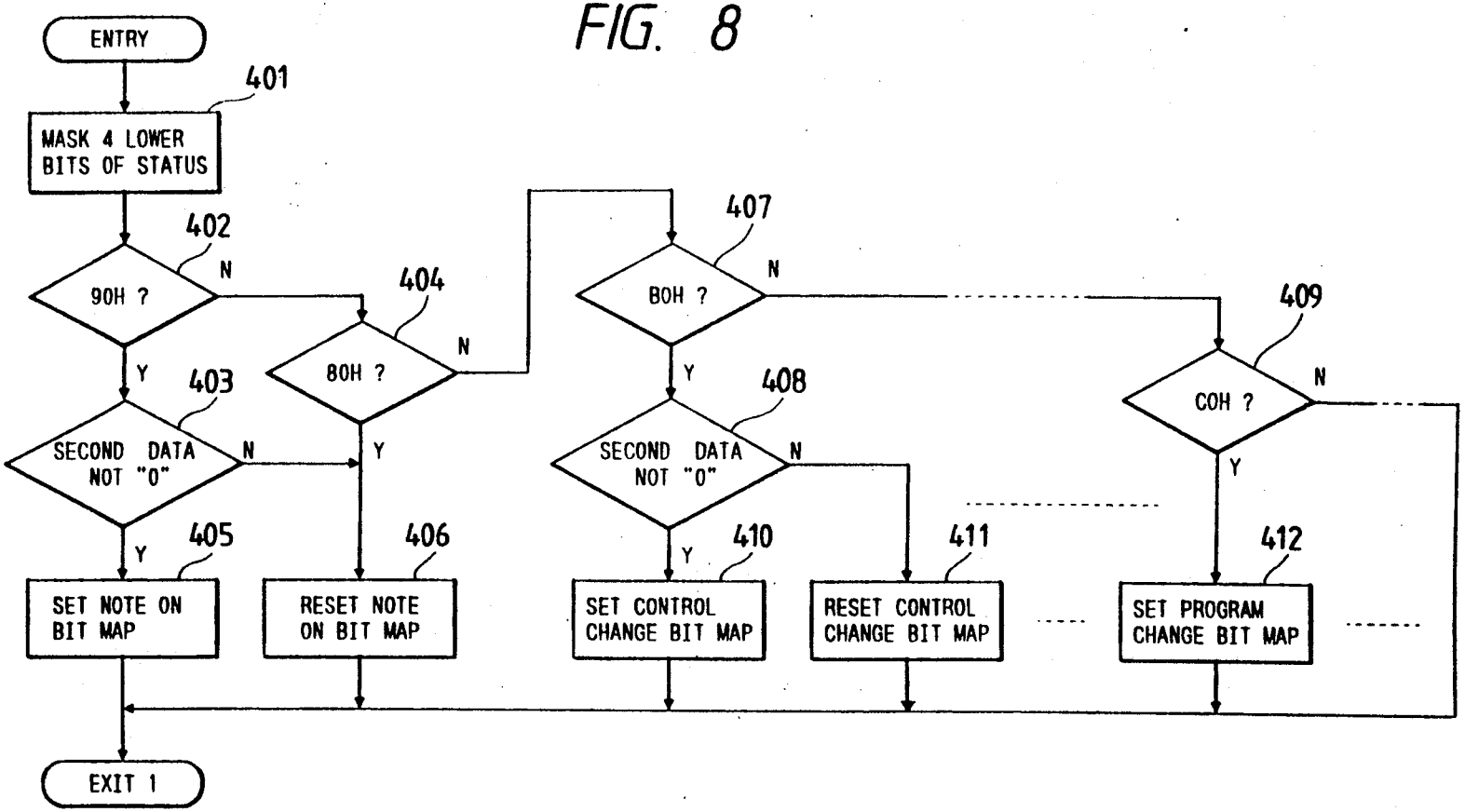
FIG. 8 is a flowchart of an internal program in the bit map writing and message transmitting block of FIG. 5.

FIG. 8 is a flowchart of an internal program of the bit map writing and message transmitting block 113. As shown in FIG. 8, a first step 401 of the block masks 4 lower bits of the stored contents of the status buffer. A step 402 following the step 401 checks whether or not the data obtained by the step 401 are equal to "90H". When the data are equal to "90H", the program advances to a step 403. When the data are not equal to "90H", the program advances to a step 404. The step 403 checks whether or not the data in the second-byte data buffer differ from "0". When the data in the second-byte data buffer differ from "0", the program advances to a block 405. When the data in the second-byte data buffer do not differ from "0", the program advances to a block 406. The block 405 sets "1" into a note on bit map. After the block 405, the program exits from the bit map writing and message outputting block 113. The block 406 resets the note on bit map. After the block 406, the program exits from the bit map writing and message outputting block 113. The step 404 checks whether or not the data obtained by the step 401 are equal to "80H". When the data are equal to "80H", the program advances to the block 406. When the data are not equal to "80H", the program advances to a step 407. The step 407 checks whether or not the data obtained by the step 401 are equal to "B0H". When the data are equal to "B0H", the program advances to a step 408. When the data are not equal to "B0H", the program advances to a step 409 via given steps (not shown). The step 408 checks whether or not the data in the second-byte data buffer differ from "0". When the data in the second-byte data buffer differ from "0", the program advances to a block 410. When the data in the second-byte data buffer do not differ from "0", the program advances to a block 411. The block 410 sets "1" into a control change bit map. After the block 410, the program exits from the bit map writing and message outputting block 113. The block 411 resets the control change bit map. After the block 411, the program exits from the bit map writing and message outputting block 113. The step 409 checks whether or not the data obtained by the step 401 are equal to "C0H". When the data are equal to "C0H", the program advances to a block 412. When the data are not equal to "C0H", the program exits from the bit map writing and message outputting block 113 via given steps (not shown). The block 412 sets "1" into a program change bit map. After the block 412, the program exits from the bit map writing and message outputting block 113.

Figure 9:
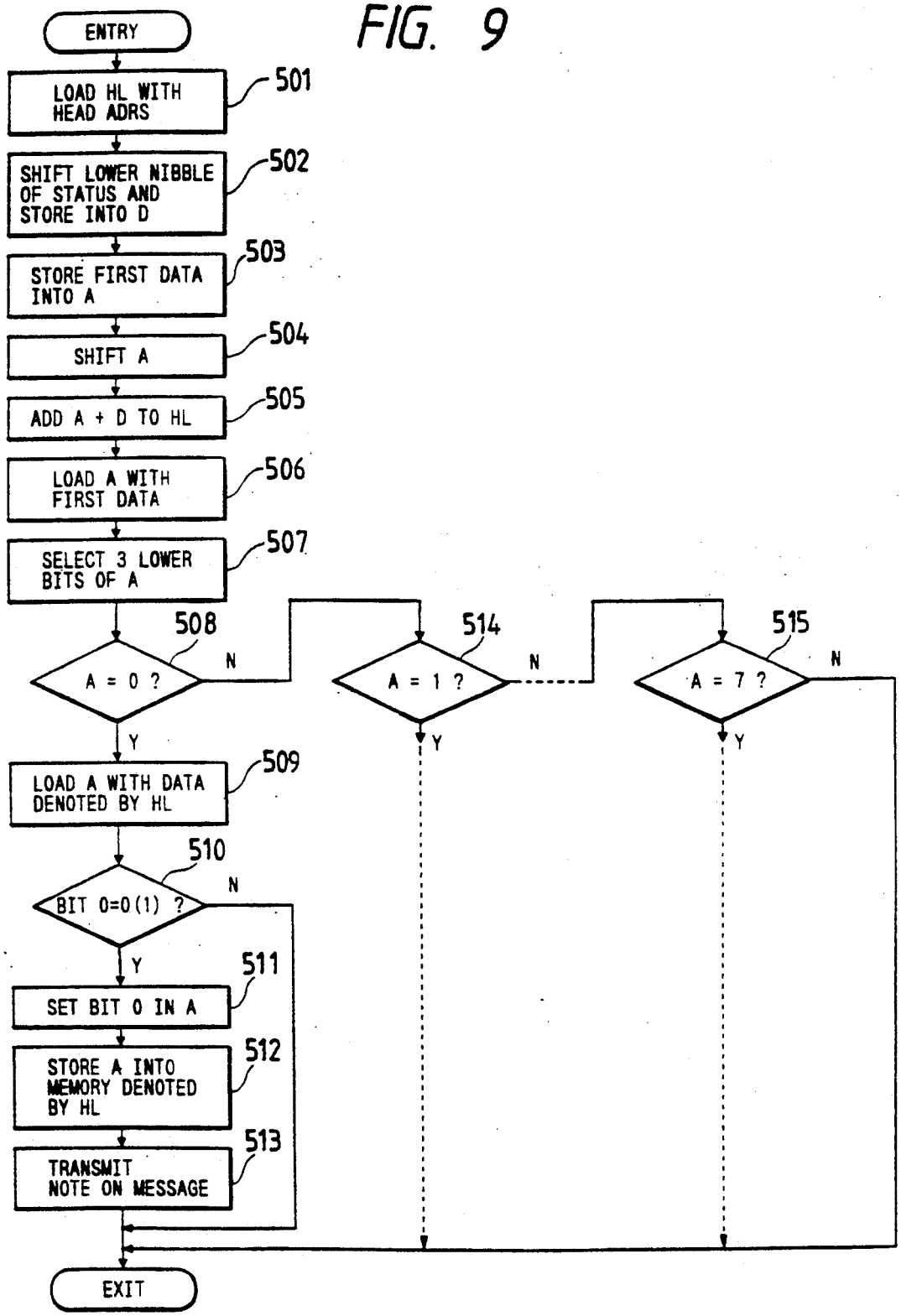
FIG. 9 is a flowchart of an internal program of the bit map setting block of FIG. 8.

FIG. 9 is a flowchart of an internal program of the bit map setting block 405. As shown in FIG. 9, a first step 501 of the block loads an HL register with a head address of the bit map. A step 502 following the step 501 shifts leftward a lower nibble of the data in the status buffer by 4 bits and stores the shifted data into a D register. A step 503 following the step 502 stores the data of the first byte into an A register. A step 504 following the step 503 shifts rightwards the data in the A register by 3 bits. A step 505 following the step 504 adds A+D to the data in the HL register. A step 506 following the step 505 loads the A register with the data of the first byte. A step 507 following the step 506 selects 3 lower bits of the data in the A register. A step 508 following the step 507 checks whether or not the 3 lower bits of the data in the A register are "0". When the 3 lower bits of the data in the A register are "0", the program advances to a step 509. When the 3 lower bits of the data in the A register are not "0", the program advances to a step 514. The step 509 loads the A register with the contents of the memory whose address is denoted by the data in the HL register. A step 510 following the step 509 checks whether or not the bit 0 (LSB) is "0". When the bit 0 is "0", the program advances to a step 511. When the bit 0 is not "0", the program exits from the block 405. The step 511 sets "1" into the bit 0 of the A register. A step 512 following the step 511 stores the value of the A register into the memory denoted by the data in the HL register. A step 513 following the step 512 transmits a 3-byte note on message. After the step 513, the program exits from the block 405. The step 514 checks whether or not the 3 lower bits of the data in the A register are "1". Similar checks are made for the values "2" to "7". In respect of each of the values "1" to "7", steps similar to the steps 509–513 of the value "0" are executed.

An internal design of the bit map resetting block 406 is similar to the internal design of the bit map setting block 405 except for the following points. In the block 406, the step 510 checks whether or not the bit 0 is "1", and the step 511 resets the bit 0 to "0" and the step 513 transmits a 3-byte note off message. The blocks 410, 411, and 412 are designed similar to the blocks 405 and 406.

Figure 10:
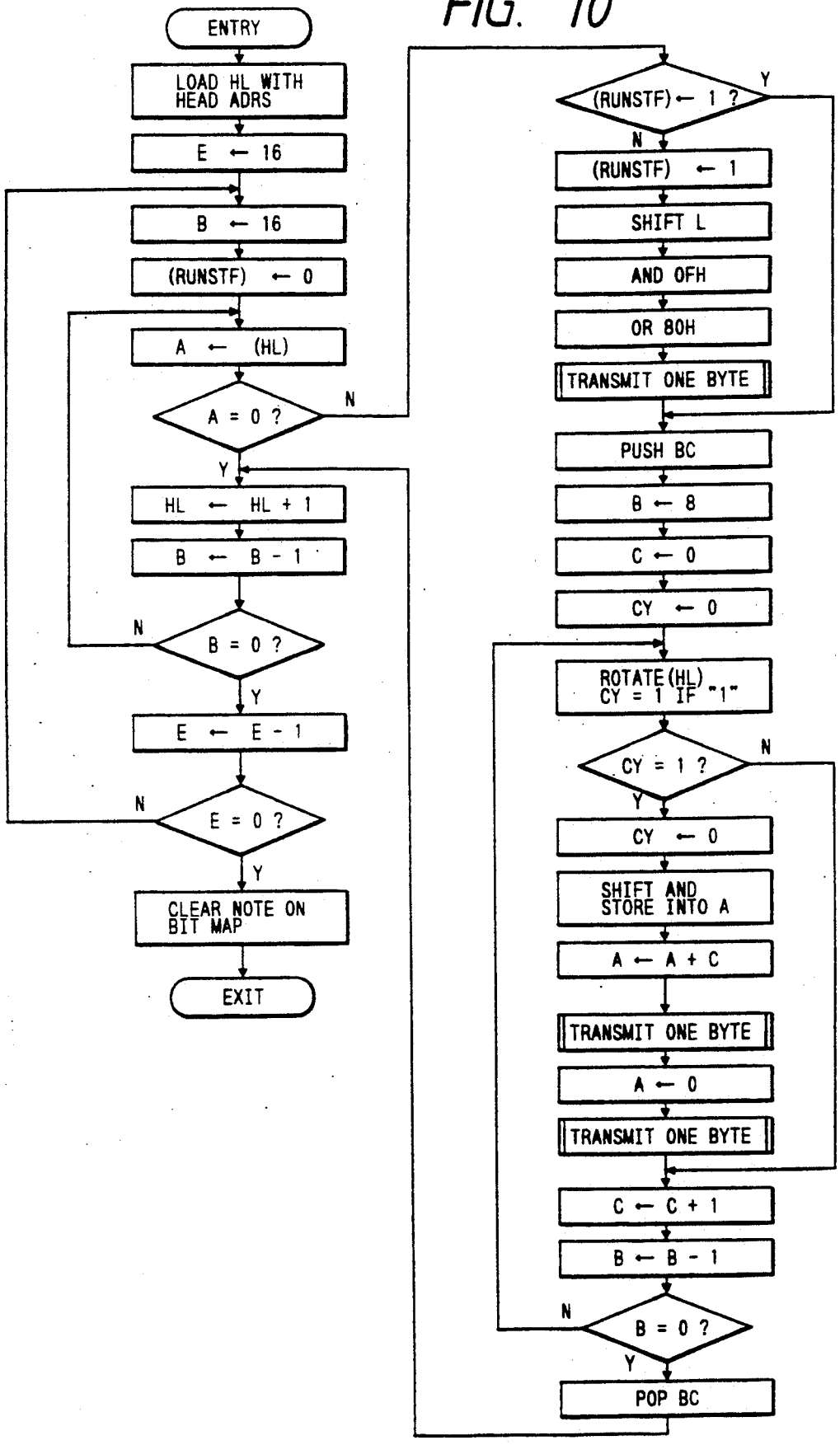
FIG. 10 is a flowchart of an internal program of the bit map reading and message transmitting block of FIG. 5.

FIG. 10 is a flowchart of an internal program of the bit map reading and message outputting block 106. As shown in FIG. 10, a first step 601 of the block loads the HL register with the head address of the note on bit map. A step 602 following the step 601 loads an E register with 16. After the step 602, the program advances to a step 603 which loads a B register with 16. A step 604 following the step 603 resets a running status flag (RUNSTF) to 0. After the step 604, the program advances to a step 605 which loads the A register with the data in the storage location denoted by the data in the HL register. A step 606 following the step 605 checks whether or not the data in the A register are equal to 0. When the data in the A register are equal to 0, the program advances to a step 607. When the data in the A register are not equal to 0, the program advances to a step 613. The step 607 increments the value in the HL register by 1. A step 608 following the step 607 decrements the value in the B register by 1. A step 609 following the step 608 checks whether or not the value in the B register equals 0. When the value in the B register equals 0, the program advances to a step 610. When the value in the B register does not equal 0, the program returns to the step 605. The step 610 decrements the value in the E register by 1. A step 611 following the step 610 checks the value in the E register equals 0. When the value in the E register equals 0, the program advances to a step 612. When the value in the E register does not equal 0, the program returns to the step 603. The step 612 clears all data in the note on bit map. After the step 612, the program exits from the block 106.

The step 613 checks whether or not the running status flag (RUNSTF) is set to 1. When the running status flag (RUNSTF) is set to 1, the program jumps to a step 619. When the running status flag (RUNSTF) is not set to 1, the program advances to a step 614 which sets the running status flag (RUNSTF) to 1. A step 615 following the step 614 shifts leftward data in an L register by 4 bits. A step 616 following the step 615 executes a logic AND operation between the data obtained by the step 615 and a predetermined value "OFH". A step 617 following the step 616 executes a logic OR operation between the data obtained by the step 616 and a predetermined value "80H". A step 618 following the step 617 transmits one byte of the data obtained by the step 617. After the step 618, the program advances to the step 619. The step 619 gives refuge to the data in the B register and a C register by transferring the data to other registers therefrom. The step 619 enables the B register and the C register to be used as new registers. A step 620 following the step 619 loads the B register with 8. A step 621 following the step 620 loads the C register with 0. A step 622 following the step 621 loads a CY register with 0. After the step 622, the program advances to a step 623. The step 623 rotates rightwards the data in the HL register, and sets "1" into the CY register if the rotated data is "1". A step 624 following the step 623 checks whether or not the value in the CY register equals 1. When the value in the CY register equals 1, the program advances to a step 625. When the value in the CY register does not equal 1, the program jumps to a step 631. The step 625 resets the value in the CY register to 0. A step 626 following the step 625 shifts leftward a lower nibble of the data in the L register by 3 bits and sets the shifted data into the A register. A step 627 following the step 626 increments the value A by the value in the C register. A step 628 following the step 627 transmits one byte of the data obtained by the step 627. A step 629 following the step 628 resets the data in the A register to 0. A step 630 following the step 629 transmits one byte of the data obtained by the step 629. After the step 630, the program advances to the step 631. The step 631 increments the value in the C register by 1. A step 632 following the step 631 decrements the value in the B register by 1. A step 633 following the step 632 checks whether or not the value in the B register equals 0. When the value in the B register equals 0, the program advances to a step 634. When the value in the B register does not equal 0, the program returns to the step 623. The step 634 sets the previously-mentioned refuge data into the B register and the C register. After the step 634, the program advances to the step 607.

The operation of the microcomputer 14 will be further described hereinafter. When the reproduced MIDI data are a note on message or a note off message, the main routine of FIG. 5 executes the write and readout of the data into and from predetermined areas of the RAM of the MIDI data buffer 10 of FIG. 1 where one bit is allotted to one note number, and also executes the data transmission. When the MIDI data are inputted into the FIFO-type or ring-type receiving buffer in the MIDI data buffer 10, the interruption process of FIG. 6 is immediately executed to transfer the MIDI data from the receiving buffer to the ring-type cue buffer of the MIDI data buffer 10. In the main routine of FIG. 5, at first, the predetermined storage areas of the RAM of the MIDI data buffer 10 are initialized to initial values different from any note numbers. The MIDI data which are decoded by the subcode signal processor 9 of FIG. 1 are sequentially processed by the microcomputer 14, and the MIDI data are temporarily held in the MIDI data buffer 10. In order to enable high-speed processing and to prevent data omission, the writing data into the MIDI data buffer 10 uses the way of writing the data into the cue buffer by the interruption process of FIG. 6. In the program main routine of FIG. 5, a check is made on whether or not the cue buffer is empty. While the cue buffer remains empty, this check is periodically reiterated. When the cue buffer is loaded with the MIDI data, the MIDI data are sequentially read out therefrom and the detection of an error generation flag is performed.

The microcomputer 14 generates a mute signal when the operation switch unit 12 is set to a non-reproducing position, when a reproduced digital output signal is absent for a predetermined time, or when the subcode data error correction circuit 8 detects an uncorrectable error in the subcodes of given frames of the reproduced digital signal. The error generation flag is set in a predetermined storage location of the RAM within the MIDI data buffer 10 in response to the mute signal. When the error generation flag is "0", a process dependent on the type of a status is executed.

Specifically, when the step 105 of FIG. 5 detects that the error generation flag is not set, the block 107 of FIG. 5 executes a process dependent on the readout data in accordance with the running status processing routine of FIG. 7. In the case where the readout data are system messages of FO to FF or subsequent data bytes, for example, in the case where the readout data are a rhythm start message FA, the flag of the rhythm start buffer in the RAM of the MIDI data buffer 10 is set by the step 310 of FIG. 7 and the program goes out via the second exit, and the readout data FA are transmitted as MIDI output data. In the case where the readout data are channel messages of EF to 80H, the readout data are stored into the status buffer of the RAM of the MIDI data buffer 10. The type of the status determines the number of the bytes of the subsequent data bytes. Until the data of the necessary number of bytes are prepared, the data of the first byte or the second byte are stored into the allotted data buffer. When the data of the necessary number of bytes have been prepared, the program goes out via the third exit and advances to the bit map writing routine of FIG. 8 so that the subsequent note on/off judgment routine is executed.

Figure 11:
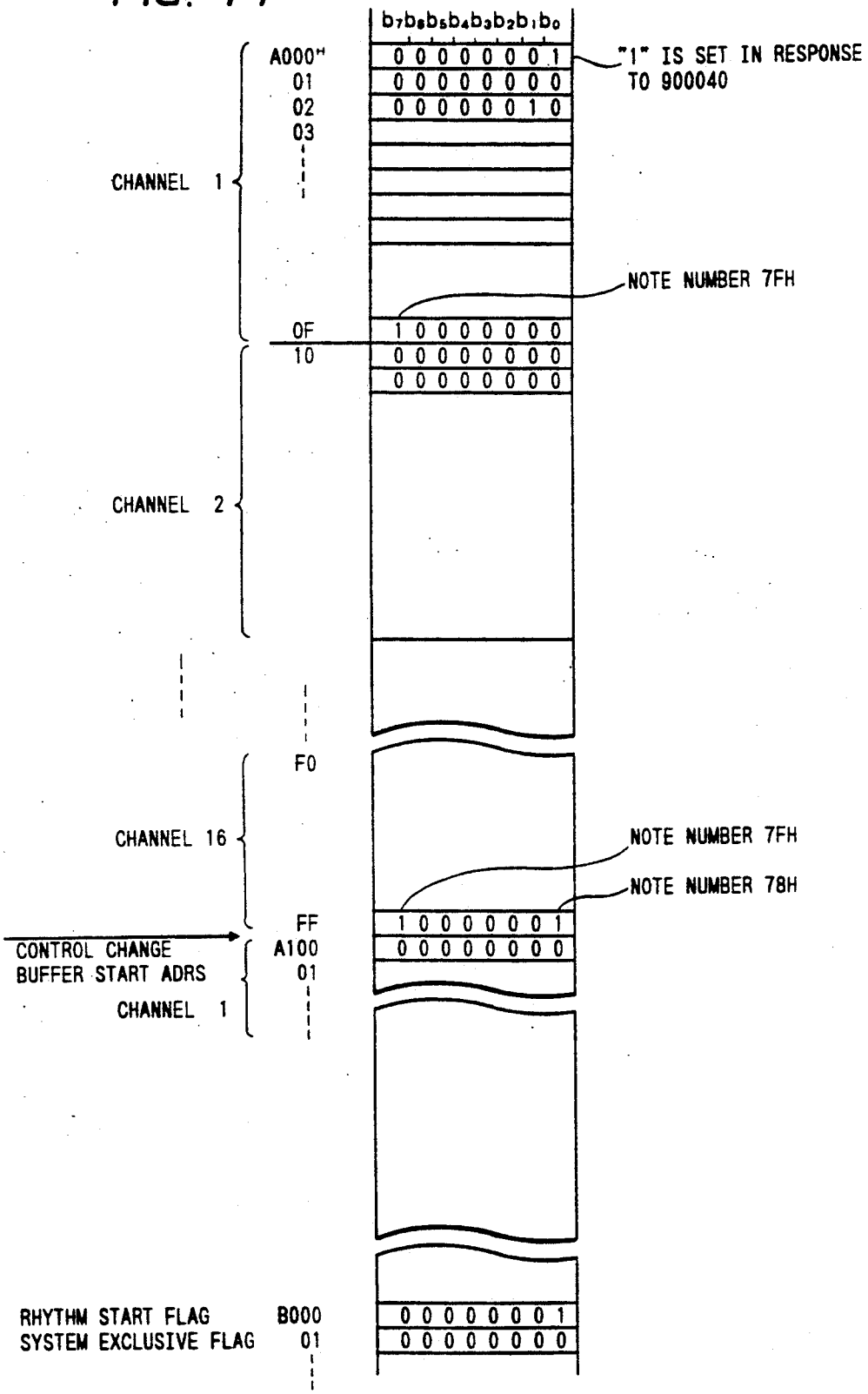
FIG. 11 is a diagram showing a state of the note on bit map in the first embodiment.

In the case where the contents of the status buffer represent a note on status or a note off status, the note on bit map writing routine is executed. FIG. 11 shows an example of a state of the note on bit map which is prepared in a predetermined area of the RAM of the MIDI data buffer 10. As shown in FIG. 11, the note on bit map is divided into 16 channels each having 16 bytes. In the case of a note on status, "1" is written into the bit in the note on bit map which corresponds to a note number in a range of 0–127. In the case of a note off status, "0" is written into the bit.

The writing processes are shown in FIGS. 8 and 9. The contents of the status buffer and the contents of the second-byte data buffer determine which of a note on status or a note off status is selected. In the case where the contents of the status buffer represent other messages, the bit map writing routine is skipped and the contents of the data buffer of the necessary number of data bytes are transmitted as MIDI output data in accordance with the contents of the status buffer and the type of the status.

A main part of this invention relates to the process of FIG. 9. The process of FIG. 9 will be further described with reference to FIG. 11. In the case where the note on message having a channel number "1" and a note number "0" is received as shown in FIG. 11, the process of FIG. 7 loads the status buffer, the first-byte data buffer, and the second-byte data buffer with 90H, 00H, and 40H respectively. Then, the program enters the process of FIG. 8 via the third exit of the block 107. Since the contents of the status buffer are 90H, the contents of the second-byte data buffer are checked. The contents of the second-byte data buffer differ from 0, and the data are judged to be a note on message. Then, the note on bit map setting and message transmitting routine of FIG. 9 is executed.

The one-byte address (A000H in this example) corresponding to the channel and note numbers is read from the head address A000H (see FIG. 11) of the note on bit map. The bit position (bit 0 in this example) of the address is derived from the 3 lower bits of the note number. When this bit is "0", that is, when a note on message is not set, the bit 0 of the data A000H is set to "1" and the resulting data are written into the storage location having the address A000H. Then, three bytes 90H, 00H, and 40H corresponding to the note on message are transmitted. When the bit 0 of the data A000H is "1", the note number is already "on" and the program directly exits from the process of FIG. 9.

In the case where the note off message is received, the note on bit map of FIG. 11 is reset. In this case, the one-byte address corresponding to the channel and note numbers is read from the head address A000H of the note on bit map. The bit position of the address is derived from the 3 lower bits of the note number. When this bit is "1", that is, when a note on message is set, the bit is reset to "0" and the resulting data are written into the storage location having the address. Then, the note off message is transmitted. When the bit is "0", the note number is already "off" and the program directly exits from the process.

Next, when the error generation flag is set to "1", the note on bit map reading routine and the note off message transmitting routine of FIG. 10 are executed. The error generation flag is cleared, and the previously-mentioned bit map is read out. The note off messages having the set channel and note numbers are sequentially transmitted. The bit map reading routine contains the transmission of respective note off messages.

During a period thereafter, when the transmission of the note off messages is completed, the program returns to the main routine of FIG. 5. Then, in order to restore various controls other than the note on control, MIDI messages such as "pitch bend off", "rhythm stop", "reset all controller", and "end of exclusive" are sequentially outputted.

As understood from the previous description, by referring to the note on bit map where one bit is allotted to one note number, a check is made as to whether the bit equals an initial value. Even in the case where the note on message is reproduced a plurality of times, when the bit is judged to be different from the initial value through the check, the second and later transmission of the note on message is inhibited. Therefore, when an uncorrectable MIDI data error occurs or an operating instruction such as "stop" and "search" is given so that a part of MIDI data disappears, it is possible to prevent the continuous generation of notes (sounds) and a malfunction of the note generation control.

DESCRIPTION OF THE SECOND PREFERRED EMBODIMENT

A second embodiment of this invention is similar to the first embodiment except for design changes indicated hereinafter. In short, a note on buffer is used instead of the note on bit map in the first embodiment.

Figure 12:
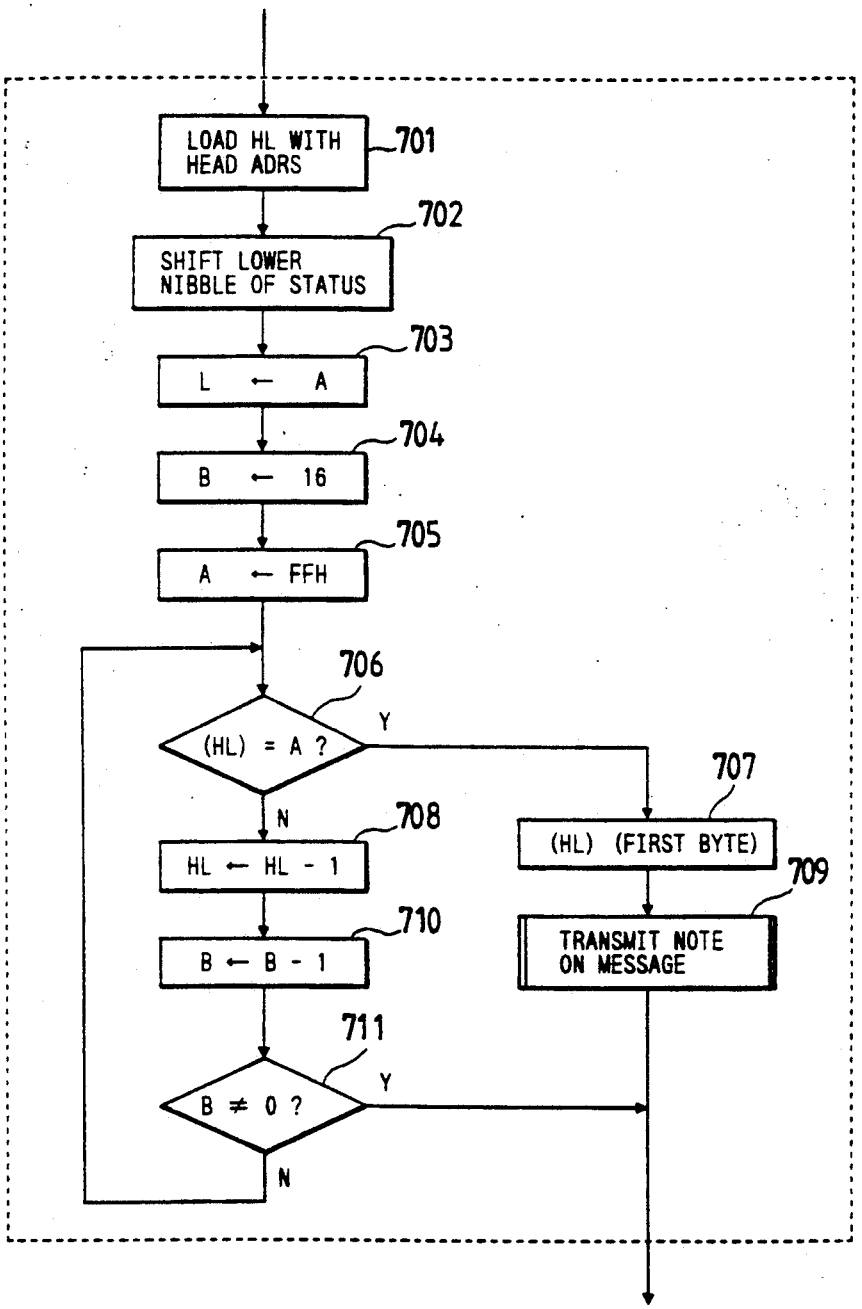
FIG. 12 is a flowchart of an internal program of a note on buffer setting block in a program according to a second embodiment of this invention.

FIG. 12 is a flowchart of an internal program of a block 405 (see FIG. 8) in the second embodiment. As shown in FIG. 12, a first step 701 of this block loads an HL register with the head address of the contents of the note on buffer. A step 702 following the step 701 shifts leftward a lower nibble of the status byte by 4 bits. A step 703 following the step 702 loads an L register with the contents of an A register. A step 704 following the step 703 loads a B register with 16. A step 705 following the step 704 loads the A register with FFH. After the step 705, the program advances to a step 706.

The step 706 checks whether or not the contents of the storage location denoted by the address in the HL register are equal to the contents of the A register. When the contents of the storage location are equal to the contents of the A register, the program advances to a step 707. When the contents of the storage location are not equal to the contents of the A register, the program advances to a step 708. The step 707 writes the data of the first byte of the data buffer into the storage location denoted by the contents of the HL register. A step 709 following the step 707 transmits a note on message. After the step 709, the program exits from the block.

The step 708 decrements the contents of the HL register by 1. A step 710 following the step 708 decrements the contents of the B register by 1. A step 711 following the step 710 checks whether or not the contents of the B register differ from 0. When the contents of the B register differ from 0, the program exits from the block. When the contents of the B register do not differ from 0, the program returns to the step 706.

Figure 13:
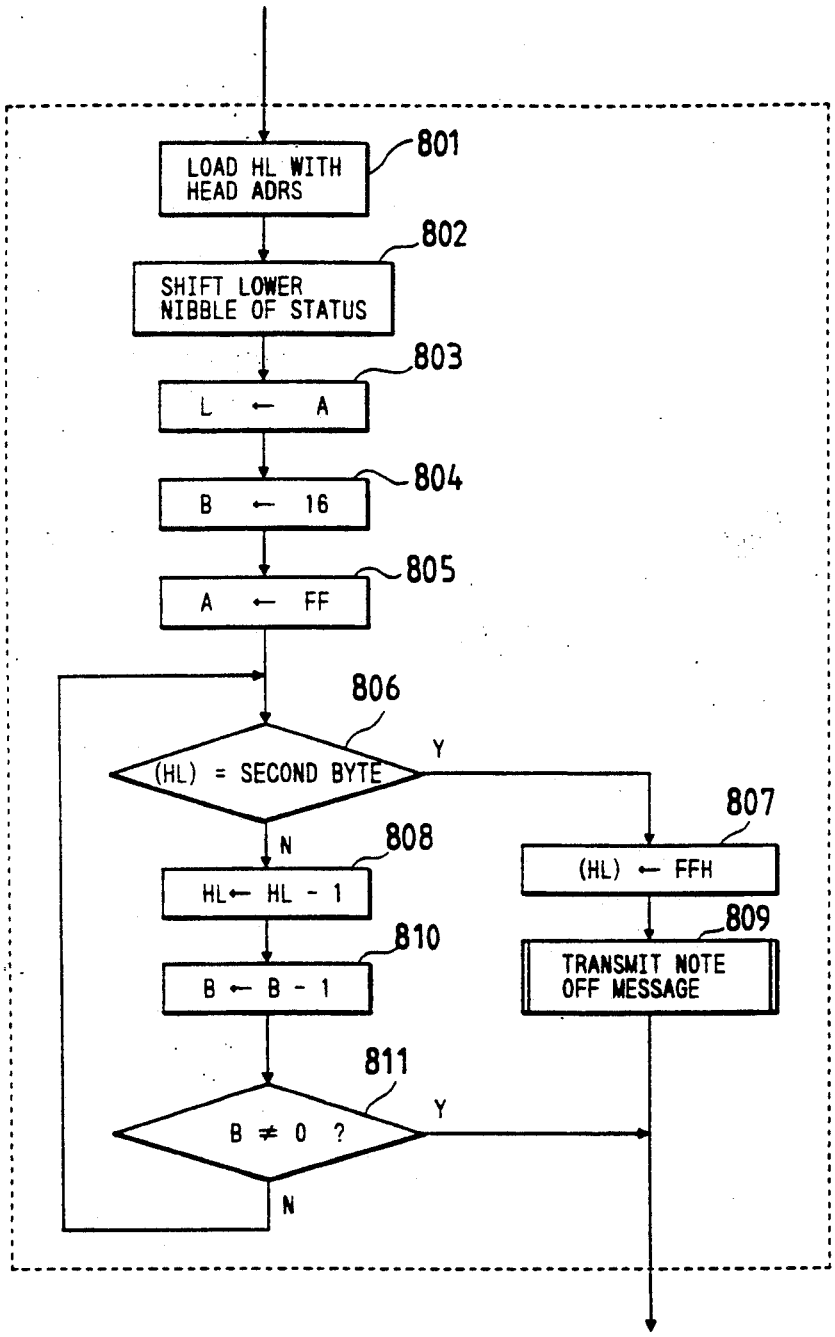
FIG. 13 is a flowchart of an internal program of a note off buffer resetting block of the program in the second embodiment.

FIG. 13 is a flowchart of an internal program of a block 406 (see FIG. 8) in the second embodiment. As shown in FIG. 13, a first step 801 of this block loads the HL register with the head address of the contents of the note on buffer. A step 802 following the step 801 shifts leftward a lower nibble of the status byte by 4 bits. A step 803 following the step 802 loads the L register with the contents of the A register. A step 804 following the step 803 loads the B register with 16. A step 805 following the step 804 loads the A register with FFH. After the step 805, the program advances to a step 806.

The step 806 checks whether or not the contents of the storage location denoted by the address in the HL register are equal to the data of the second byte. When the contents of the storage location are equal to the data of the second byte, the program advances to a step 807. When the contents of the storage location are not equal to the data of the second byte, the program advances to a step 808. The step 807 writes FFH into the storage location denoted by the contents of the HL register. A step 809 following the step 807 transmits a note off message. After the step 809, the program exits from the block. The step 808 decrements the contents of the HL register by 1. A step 810 following the step 808 decrements the contents of the B register by 1. A step 811 following the step 810 checks whether or not the contents of the B register differ from 0. When the contents of the B register differ from 0, the program exits from the block. When the contents of the B register do not differ from 0, the program returns to the step 806.

Figure 14:
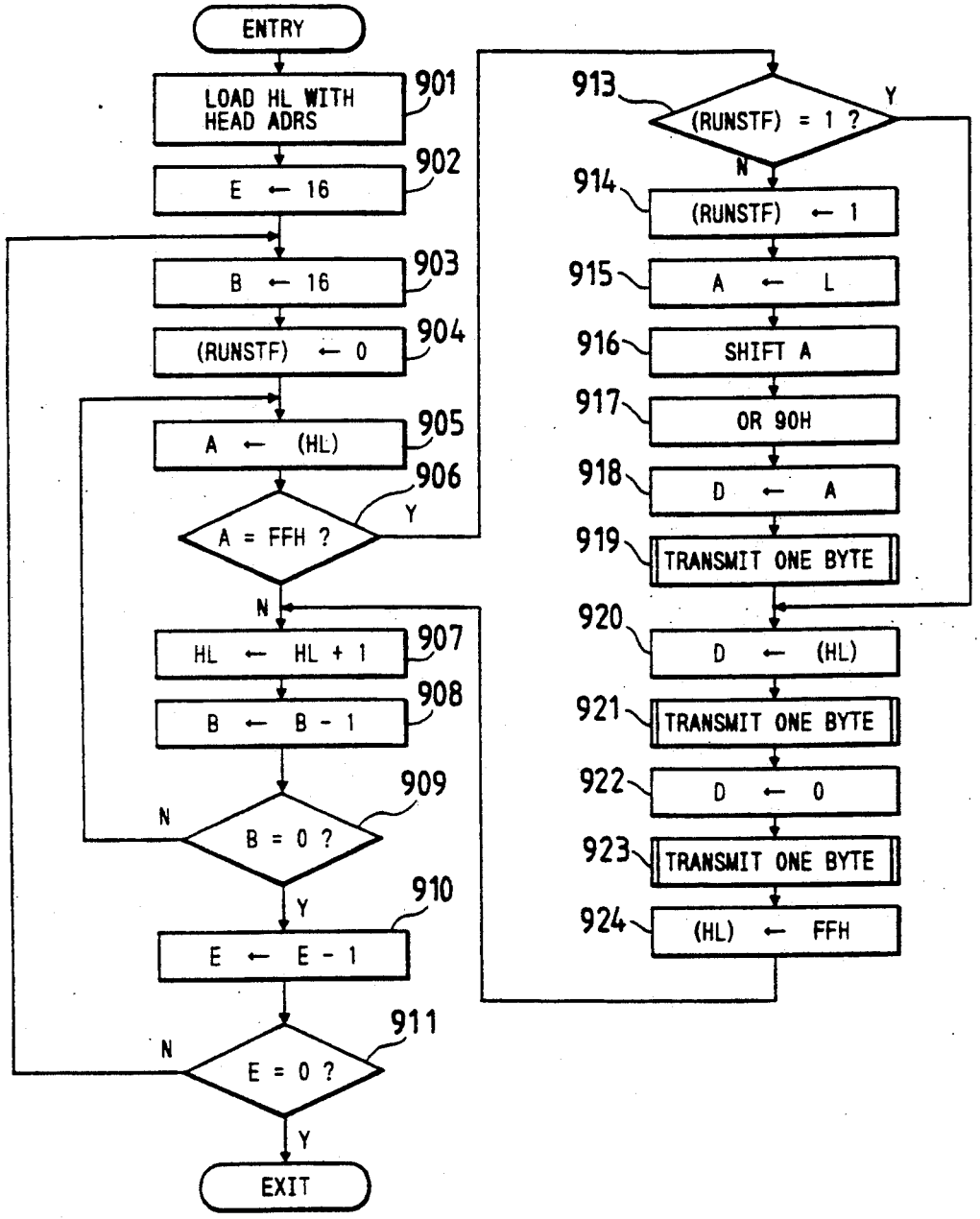
FIG. 14 is a flowchart of an internal program of a note on buffer reading and message transmitting block of the program in the second embodiment.

FIG. 14 is a flowchart of an internal program of a block 106 (see FIG. 5) in the second embodiment. As shown in FIG. 14, a first step 901 of this block loads the HL register with the head address of the data in the note on buffer. A step 902 following the step 901 loads an E register with 16. After the step 902, the program advances to a step 903 which loads the B register with 16. A step 904 following the step 903 resets the running status flag (RUNSTF) to 0. After the step 904, the program advances to a step 905 which loads the A register with the data in the storage location denoted by the contents of the HL register. A step 906 following the step 905 checks whether or not the contents of the A register are equal to FFH. When the contents of the A register are equal to FFH, the program advances to a step 913. When the contents of the A register are not equal to FFH, the program advances to a step 907. The step 907 increments the contents of the HL register by 1. A step 908 following the step 907 decrements the contents of the B register by 1. A step 909 following the step 908 checks whether or not the contents of the B register are equal to 0. When the contents of the B register are equal to 0, the program advances to a step 910. When the contents of the B register are not equal to 0, the program returns to the step 905. The step 910 decrements the contents of the E register by 1. A step 911 following the step 910 checks the contents of the E register are equal to 0. When the contents of the E register are equal to 0, the program exits from the block. When the contents of the E register are not equal to 0, the program returns to the step 903.

The step 913 checks whether or not the running status flag (RUNSTF) is 1. When the running status flag (RUNSTF) is 1, the program jumps to a step 920. When the running status flag (RUNSTF) is not 1, the program advances to a step 914 which sets the running status flag (RUNSTF) to 1. A step 915 following the step 914 transfers the data from an L register to the A register. A step 916 following the step 915 shifts leftward the contents of the A register by 4 bits. A step 917 following the step 916 executes a logic OR operation between the data obtained by the step 916 and a predetermined value "90H". A step 918 following the step 917 transfers the data from the A register to a D register. A step 919 following the step 918 transmits one byte of the MIDI data. After the step 919, the program advances to the step 920. The step 920 loads the D register with the data in the storage location denoted by the contents of the HL register. A step 921 following the step 920 transmits one byte of the MIDI data. A step 922 following the step 921 loads the D register with 0. A step 923 following the step 922 transmits one byte of the MIDI data. A step 924 following the step 923 writes FFH into the storage location denoted by the contents of the HL register. After the step 924, the program advances to the step 907.

The operation of the second embodiment will be further described hereinafter. When the reproduced MIDI data are a note on message or a note off message, a main routine of a program (see FIG. 5) executes the write and readout of the data into and from predetermined areas of a RAM of a MIDI data buffer 10 (see FIG. 1) where one byte is allotted to one note on message, and also executes the data transmission. This predetermined area is designated as the note on buffer. When the MIDI data are inputted into a FIFO-type or ring-type receiving buffer in the MIDI data buffer 10 (see FIG. 1), an interruption process (see FIG. 6) is immediately executed to transfer the MIDI data from the receiving buffer to a ring-type cue buffer of the MIDI data buffer 10 (see FIG. 1). In the main routine of the program, at first, the predetermined storage areas of the RAM of the MIDI data buffer 10 (see FIG. 1) are initialized to initial values different from any note numbers. The MIDI data which are decoded by a subcode signal processor 9 (see FIG. 1) are sequentially processed by a microcomputer 14 (see FIG. 1), and the MIDI data are temporarily held in the MIDI data buffer 10 (see FIG. 1). In order to enable high-speed processing and to prevent data omission, the writing data into the MIDI data buffer 10 (see FIG. 1) uses the way of writing the data into the cue buffer by the interruption process (see FIG. 6). In the main routine of the program, a check is made on whether or not the cue buffer is empty. While the cue buffer remains empty, this check is periodically reiterated. When the cue buffer is loaded with the MIDI data, the MIDI data are sequentially read out therefrom and the detection of an error generation flag is performed.

The microcomputer 14 (see FIG. 1) generates a mute signal when the operation switch unit 12 (see FIG. 1) is set to a non-reproducing position, when a reproduced digital output signal is absent for a predetermined time, or when the subcode data error correction circuit 8 detects an uncorrectable error in the subcodes of given frames of the reproduced digital signal. The error generation flag is set in a predetermined storage location of the RAM within the MIDI data buffer 10 (see FIG. 1) in response to the mute signal. When the error generation flag is "0", a process dependent on the type of a status is executed.

Specifically, when a step 105 (see FIG. 5) detects that the error generation flag is not set, a block 107 (see FIG. 5) executes a process dependent on the readout data in accordance with a running status processing routine (see FIG. 7). In the case where the readout data are system messages of F0 to FF or subsequent data bytes, for example, in the case where the readout data are a rhythm start message FA, the flag of the rhythm start buffer in the RAM of the MIDI data buffer 10 is set by a step 310 (see FIG. 7) and the program goes out via a second exit, and the readout data FA are transmitted as MIDI output data. In the case where the readout data are channel messages of EF to 80H, the readout data are stored into the status buffer of the RAM of the MIDI data buffer 10 (see FIG. 1). The type of the status determines the number of the bytes of the subsequent data bytes. Until the data of the necessary number of bytes are prepared, the data of the first byte or the second byte are stored into the allotted data buffer. When the data of the necessary number of bytes have been prepared, the program goes out via a third exit and advances to a note on buffer writing routine (corresponding to the note on bit map writing routine of FIG. 8) so that the subsequent note on/off judgment routine is executed.

Figure 15:
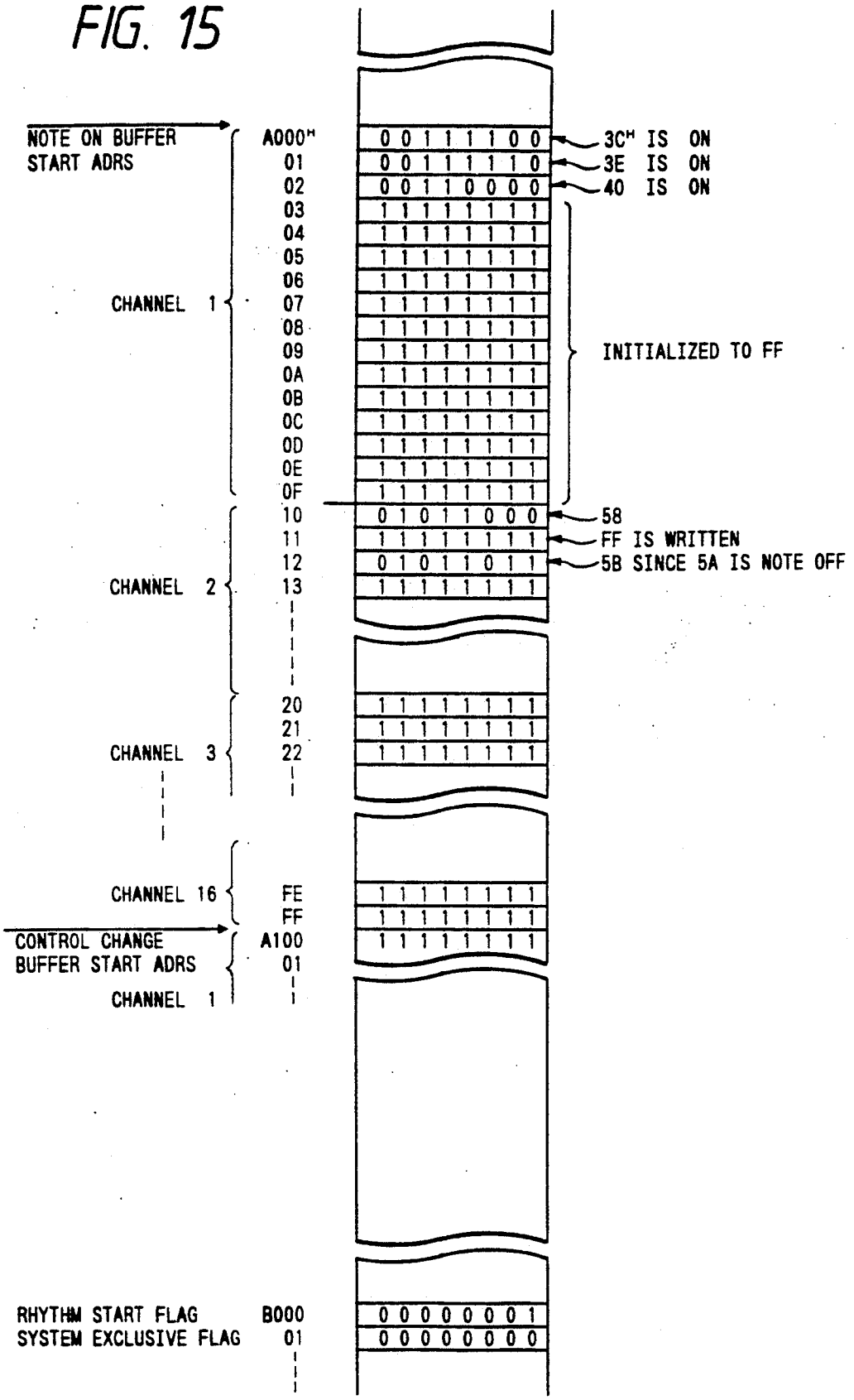
FIG. 15 is a diagram showing a state of a note on buffer in the second embodiment.

In the case where the contents of the status buffer represent a note on status or a note off status, the note on buffer writing routine is executed. The writing processes which form a main part of this invention are shown in FIGS. 12 and 13. The writing processes will be described with reference to FIG. 15. FIG. 15 shows an example of a state of the note on buffer on a RAM map in the MIDI data buffer 10 (see FIG. 1) into which one-byte data are sequentially written as one note number. As shown in FIG. 15, the MIDI data buffer 10 has storage areas A000H to AOFFH whose capacity is 256 bytes. The 256 bytes are divided into 16 channels each having 16 bytes. A note number corresponding to every note on message is written into these storage areas. According to the MIDI standards, the note number is in the range of 0 to 7FH. At first, these areas are initialized to a value FFH which differs from any note numbers.

In the case where a note on message related to the central C note of the first channel is received, the status buffer and the first-byte and second-byte data buffers are loaded with 90H, 3CH, and 40H of the note on status byte, the key number (note number), and the key velocity. Then, the process of FIG. 12 is executed. Since the 4 lower bits of the status byte are "0", the data of 16 bytes which starts from the address A000H are read out and a search for an un-initialized address (an address into which any note number is not written) is made. In this example, since FFH is immediately detected, the data of the first byte (the note number 3CH) in the data buffer are written into the storage location denoted by the address A000H and then the status byte and the first and second data bytes are outputted as MIDI data. Thereafter, the program returns to the main routine. Next, when the 3EH and 40H are read out from the data buffers, the running status process rewrites the data buffer but does not rewrite the status buffer and the write of the data into the note on buffer is executed in a manner similar to the previously-mentioned manner. In this example, since 3CH is already written in the storage location of the address A000H and the initial value FFH is held in the storage location of the subsequent address A001H, the address is incremented and the storage location of the resulting address A001H is loaded with 3EH.

In the case where a note off message is received, the process of FIG. 13 is executed. The data of 16 bytes which start from the address A000H are read out. When the same note numbers are detected, FFH is written into the storage locations of the corresponding addresses, and the contents of the status buffer and the first byte and second byte data buffers are transmitted as MIDI output data. In cases where there are two note on messages related to the same note number in the same channel, the data of the same values are written into the storage locations of different addresses in the same channel region of the note on buffer. In cases where 16 note on messages are successively received, the note on buffer is completely filled, and further write of data into the note on buffer is inhibited and the transmission of the MIDI data is inhibited.

When the error generation flag is set, the note on buffer reading and message transmitting process of FIG. 14 is executed. The data of 16 bytes by 16 channels are sequentially read out from the note on buffer. When the readout data disagree with FFH, a note off message is transmitted. In order to sequentially change the channel number for each of an inner loop of the process of FIG. 14, the running status flag (RUNSTF) is set to "0" and then the running status flag (RUNSTF) is set to "1" when the status is transmitted. In respect of the subsequent message, only its data bytes are transmitted. In order to enable high-speed transmission of the MIDI data, the second byte of the data is set to "0" and the note on status 9nH is transmitted. In the MIDI format, the second byte or the first data byte of the note on message indicates an intensity of a note (sound), and therefore this message and the note off message are the same. After the note off message is transmitted, FFH is written into the storage location of the related address to initialize the storage location.

During a period thereafter, when the reading of the data from the note on buffer and the transmission of the note off messages are completed, the program returns to the main routine of FIG. 5. Then, in order to restore various controls other than the note on control, MIDI messages such as "pitch bend off", "rhythm stop", "reset all controller", and "end of exclusive" are sequentially outputted.

As understood from the previous description, note numbers are sequentially registered into the note on buffer where at least one byte is allotted to one note number. Upon the reception of a note off message, a searching process is performed on the amount of the bytes of the related channel. When the searching process finds the presence of the two same note numbers, the storage locations of the related addresses are initialized to a predetermined value different from any note numbers. Thus, even in cases where a plurality of note on messages related to the same note number in the same channel are successively reproduced, the corresponding note (sound) can be surely made off. Therefore, when an uncorrectable MIDI data error occurs or an operating instruction such as "stop" and "search" is given so that a part of MIDI data disappears, it is possible to prevent the continuous generation of notes (sounds) and a malfunction of the note generation control.

What is claimed is:

1. A MIDI signal processor comprising:

means for extracting note on messages and note off messages from an input MIDI signal;

means for detecting that a first extracted note on message of a channel number and a note number is followed by a second extracted note on message of said channel number and said note number but is not immediately followed by an extracted note off message of said channel number and said note number; and means for outputting the first note on message but inhibiting output of the second note on message when said detecting means detects that the first note on message is followed by the second note on message but is not immediately followed by the note off message.

2. A MIDI signal processor comprising:

means for reading out a signal from a digital signal recording medium having a sub signal recording area storing MIDI data;

decoding means for subjecting the readout signal to an EFM decoding process;

means for generating a control signal when an uncorrectable error occurs, when a non-reproducing condition occurs, and when a part of the signal diappears;

a memory having a predetermined area where at least one bit is allotted to each of different MIDI messages;

means for initializing the predetermined area of the memory to initial values;

means for, in cases where MIDI data reproduced by the decoding means is a message representing a non-default state, reading a predetermined bit in a predetermined address of the predetermined region of the memory which corresponds to said message, writing a value different from the initial value into the read bit and transmitting the reproduced MIDI message when the read bit equals the initial value, and inhibiting transmission of the reproduced MIDI message when the read bit differs from the initial value;

means for, in cases where MIDI data reproduced by the decoding means is a message representing a default state, reading a predetermined bit in a predetermined address of the predetermined region of the memory which corresponds to said message, writing the initial value into the read bit and transmitting the reproduced MIDI message when the read bit differs from initial value, and inhibiting transmission of the reproduced MIDI message when the read bit equals the initial value; and means for, in cases where the control signal is generated, reading the predetermined area of the memory, transmitting a message representing a default state of a MIDI message corresponding to a bit of an address which differs from the initial value, and writing the initial value into said bit of said address.

3. A MIDI signal processor comprising:

means for reading out a signal from a digital signal recording medium having a sub signal recording area storing MIDI data;

decoding means for subjecting the readout signal to an EFM decoding process;

means for generating a control signal when an uncorrectable error occurs, when a non-reproducing condition occurs, and when a part of the signal disappears;

a memory having a predetermined area where at least one byte is allotted to one note number;

means for initializing the predetermined area of the memory to initial values different from any note numbers;

means for, in cases where MIDI data reproduced by the decoding means is a note on message, sequentially writing a value corresponding to a note number of the note on message into addresses of a pre-initialized storage area of the memory; and control means for, in cases where MIDI data reproduced by the decoding means is a note off message, initializing a value corresponding to a note number of the note off message when the value was written into the storage area, and inhibiting transmission of a note on message to MIDI output in an absence of an initialized address, the control means being operative to, in cases where the control signal is generated, search the storage area and generate and transmit a note off message of a note number corresponding to a value in a non-initialized address to the MIDI output.

4. A MIDI signal processor as recited in claim 3 wherein said predetermined area of said memory is mapped as a plurality of channels each having a plurality of note numbers thereby identifying each note by a bit map address comprising a channel number and said note number.

5. A MIDI signal processor as recited in claim 1 wherein said channel number and note number designate a predetermined note in accordance with a note on bit map and wherein said means for detecting detects successive note on messages extracted for said note without an intervening note off message therefor.

6. A MIDI signal processor comprising:

extracting means for extracting note on messages and note off messages from an input MIDI signal;

detecting means for detecting that a first extracted note on message for a note designated by a first bit map address defined by a first channel number and a first note number is followed by a second extracted note on message for said note designated by said first bit map address without an intervening extracted note off message for said note designated by said first bit map address; and means for outputting the first note on message but inhibiting output of the second note on message when said detecting means detects that the first note on message is followed by the second note on message without an intervening note off message.

7. A MIDI signal processor as recited in claim 6 wherein said first bit map address comprising said first channel number and said first note number designates a predetermined note in accordance with a note on bit map.

* * * * *